US008693709B2

(12) United States Patent
Schneider

(10) Patent No.: US 8,693,709 B2
(45) Date of Patent: Apr. 8, 2014

(54) AUDIO SPEAKERS

(75) Inventor: Allan Schneider, Girouxville (CA)

(73) Assignees: Allen Schneider (CA); Robert Stegmeier (CA); Gerald Chmilar (CA)

( * ) Notice: Subject to any disclaimer, the term of this patent is extended or adjusted under 35 U.S.C. 154(b) by 226 days.

(21) Appl. No.: 12/713,488

(22) Filed: Feb. 26, 2010

(65) Prior Publication Data

US 2010/0215206 A1 Aug. 26, 2010

(30) Foreign Application Priority Data

Feb. 26, 2009 (CA) ..... 2655585

(51) Int. Cl.
*H04R 25/00* (2006.01)

(52) U.S. Cl.
USPC ..... 381/161; 361/161; 361/162; 361/163; 361/395

(58) Field of Classification Search
USPC ..... 381/372; 181/141, 143, 127, 161, 162, 181/166
See application file for complete search history.

(56) References Cited

U.S. PATENT DOCUMENTS

| | | | | |
|---|---|---|---|---|
| 4,071,110 | A * | 1/1978 | Payne | 181/127 |
| 4,597,099 | A * | 6/1986 | Sawafuji | 381/190 |
| 7,180,225 | B2 * | 2/2007 | Sashida et al. | 310/330 |
| 2009/0316413 | A1 * | 12/2009 | Henry | 362/294 |

* cited by examiner

*Primary Examiner* — Davetta W. Goins
*Assistant Examiner* — Amir Etesam
(74) *Attorney, Agent, or Firm* — Davis & Bujold, PLLC; Michael J. Bujold

(57) ABSTRACT

An audio speaker has at least one transducer for converting electrical signals into mechanical motion. There is a planar sound producing structure that has a first face and a second face. A mechanical connection connects the at least one transducer to the sound producing structure, such that mechanical motion produced by the at least one transducer induces the sound producing structure to vibrate and produces sound from the first face and the second face. A deflector is interposed between the at least one transducer and the sound producing structure. The deflector is adjacent to the second face of the sound producing structure and reflects the produced sound from the second face of the sound producing structure to a listening area forward of the first face.

19 Claims, 3 Drawing Sheets

AUDIO SPEAKERS

FIELD

Audio speakers

BACKGROUND

Traditionally, the drivers of an audio speaker are positioned in an enclosure to prevent negative interference between sound produced at the front and at the back of the driver.

SUMMARY

There is provided an audio speaker which includes one or more transducers for converting electrical signals into mechanical motion and a planar sound producing structure having a first face and a second face. A mechanical connection connects each transducer to the sound producing structure, such that mechanical motion produced by each transducer induces the sound producing structure to vibrate and produces sound from the first face and the second face. A deflector is interposed between the transducers and the sound producing structure. The deflector is positioned adjacent to the second face of the sound producing structure to reflect the produced sound from the second side of the sound producing structure to a listening area forward of the first face.

While there are various configurations of mechanical connection which can be used, beneficial results have been obtained through the use of a push rod that is moved axially by the transducer. If desired, fins may be provided on the push rod to dissipate heat generated by the transducer.

Although the audio speaker can function with a single transducer, even more beneficial results may be obtained when there is more than one transducer with each transducer being connected to the sound producing structure by a dedicated push rod. Having more than one transducer divides the load. Instead of single transducer operating near its limits, two or more transducers operate with greatly increased capacity.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 2:
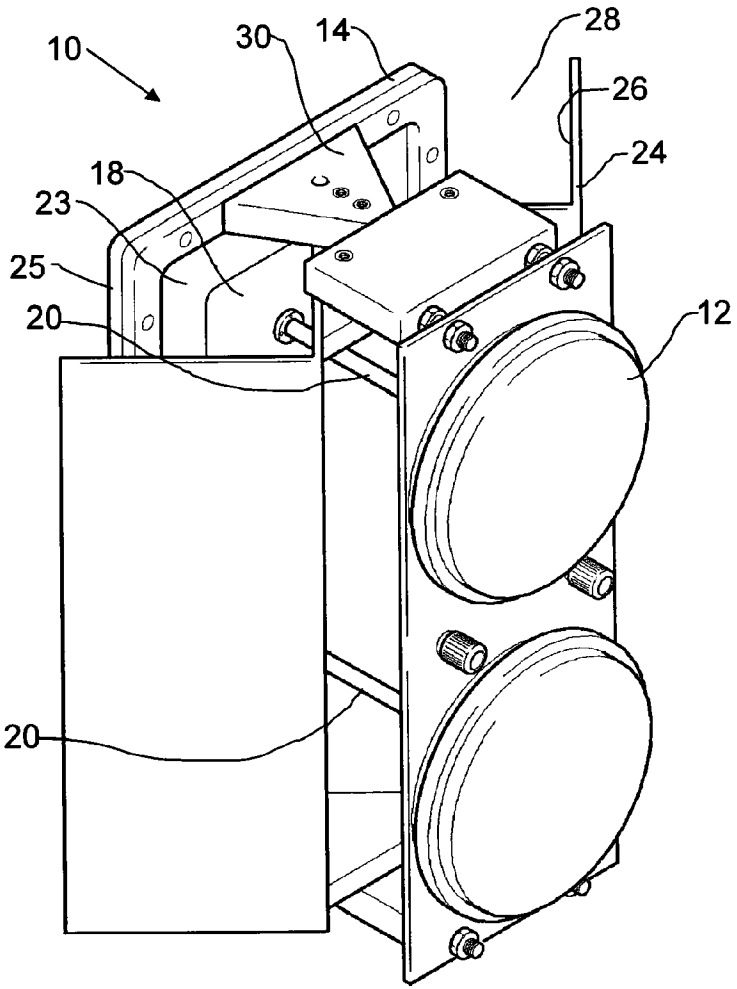
FIG. 2 is a rear perspective view of the audio speaker of FIG. 1.

An audio speaker generally identified by reference numeral 10, will now be described with reference to FIG. 1 through 5.

Figure 1:
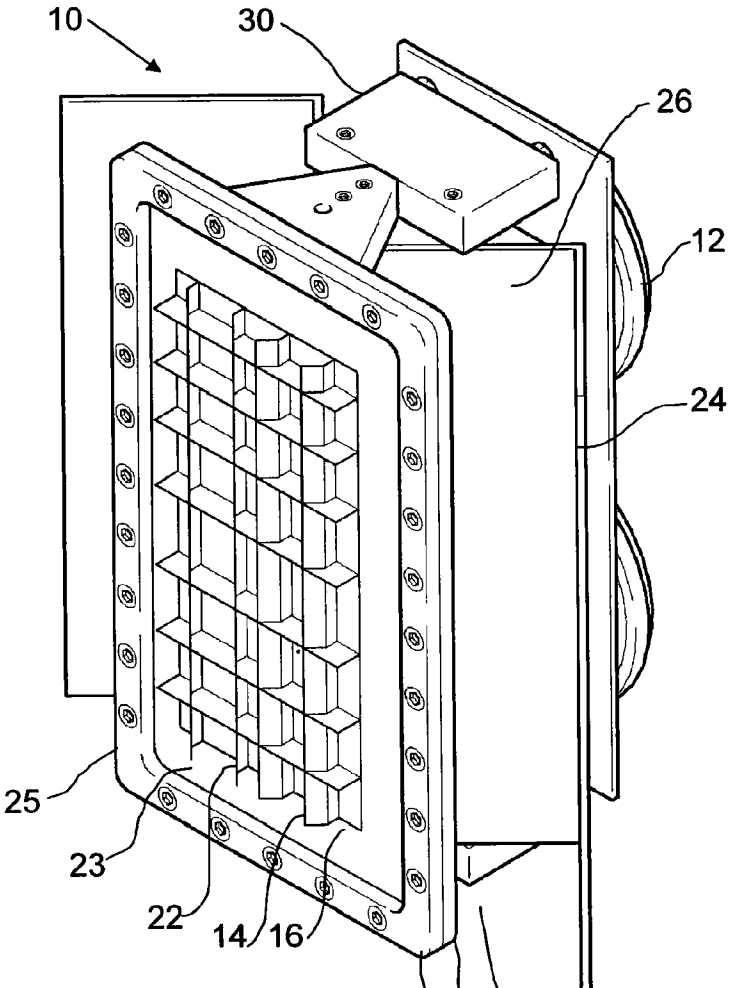
FIG. 1 is a front perspective view of an audio speaker.
Figure 4:
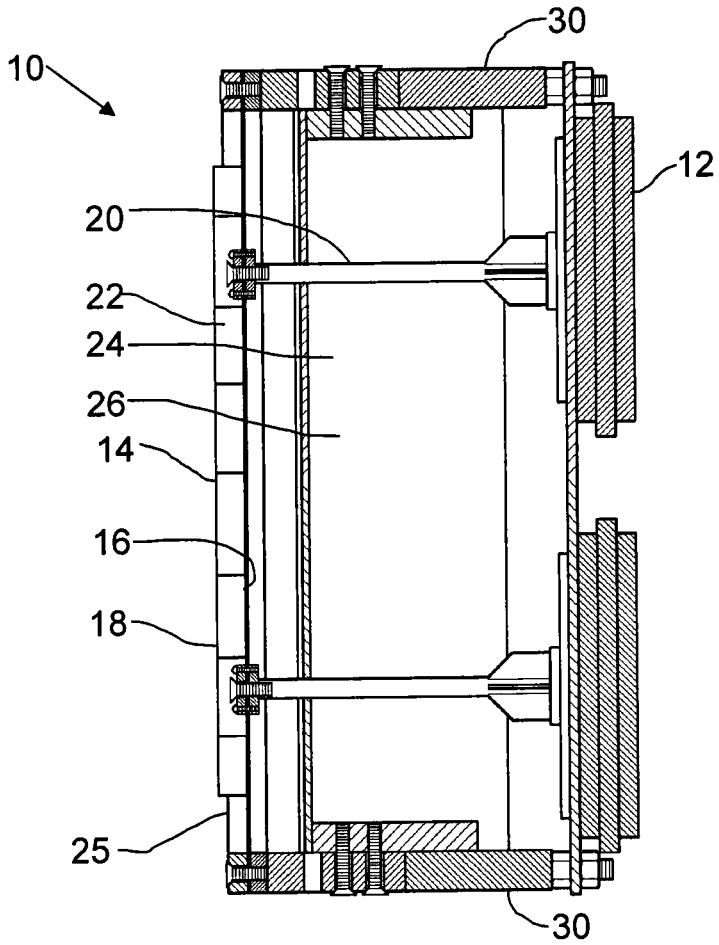
FIG. 4 is a side elevation view in section of the audio speaker of FIG. 1.

Structure and Relationship of Parts:

Referring to FIG. 2, audio speaker 10 has a transducer 12 for converting electrical signals into vibrations, two of which are shown in the depicted embodiment, and, referring to FIG. 1, a planar sound producing structure 14 that has a first face 16 and a second face 18. There is a mechanical connection that connects transducers 12 to sound producing structure 14. As depicted in FIG. 4, the mechanical connection is a rigid rods 20 that extends from the centre of each transducer 12 that are used to sound producing structure 14. The design causes the mechanical motion, or vibrations, produced by transducer 12 to induce sound producing structure 14 to produce sound from first face 16 and second face 18.

Referring to FIG. 1, in the depicted embodiment, sound producing structure 14 is a grid made up of strips of material 22. These strips may be angled such that produced sound is directed in various directions. It will be apparent that other transducers, mechanical connections and sound producing structures 14 may also be used to obtain different embodiments that operate using the same principle. Materials for the various components will be recognized by those skilled in the art to produce the desires performance from audio speaker 10. While the depicted embodiment provides certain advantages based on frequency response, manufacturing costs, etc., the design may be varied based on a user's preferences. Sound producing structure 14 may also include a diaphragm 23 supported by a diaphragm supporting structure 25 that includes two frame members 27 that provide rigid support around a periphery of diaphragm 23. As shown, grid 22 is supported and surrounded by diaphragm 23.

Figure 3:
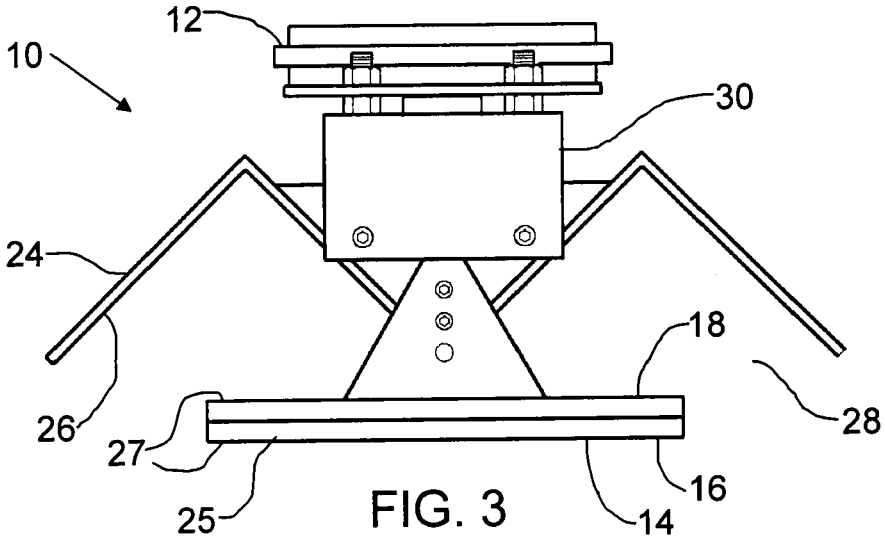
FIG. 3 is a top plan view of the audio speaker of FIG. 1.

Referring to FIG. 3, a sound deflector 24 is interposed between transducer 12 and sound producing structure 14. Sound deflector 24 is adjacent to second face 18 of sound producing structure 14 and reflects produced sound from second face 18 of the sound producing structure. Sound deflector 24 is designed to have an angled sound reflecting surface 26 for reflecting the produced sound around sound producing structure 14. As shown, deflector 24 is shaped as a "W", with the apex at the centre of sound producing structure 14, such that sound that is directed backward is reflected off the deflector twice, and then outward. Other shapes may also be used to obtain desirable results. Sound that is reflected from second face 18 is directed toward a listening area forward of first face 16.

In a preferred embodiment, referring to FIG. 4, the space 28 between sound deflector 24 and sound producing structure 14 is substantially open, aside from the structural components 30 required to fix the position of each. In addition, transducers 12 are also preferably not enclosed in a housing. It is believed that, by not providing a housing, feedback caused by resonant frequencies can be reduced by reducing the number of resonant points.

Figure 5:
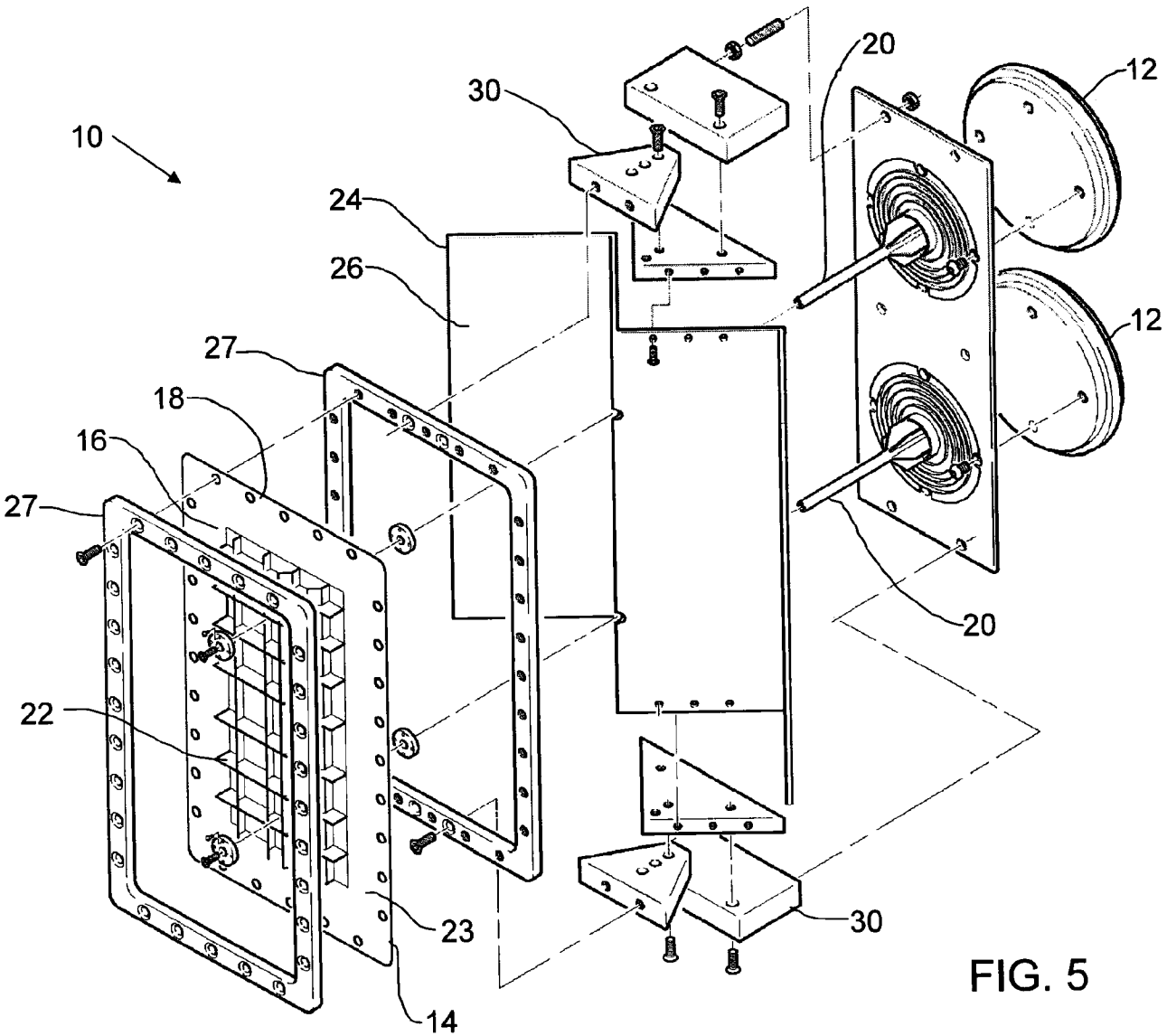
FIG. 5 is an exploded perspective view of the audio speaker of FIG. 1

Operation:

Referring to FIG. 5, audio speaker 10 is assembled as described above, with rigid rods 20 connected between transducers 12 and sound producing structure 14, and deflector 24 interposed between transducers 12 and sound producing structure 14.

Transducer 12 is connected to an electric signal that it converts into vibrations. These vibrations are transmitted to sound producing structure 14 by rigid rods 20. Sound producing structure begins vibrating, and generates compression sound waves from first face 16 and second face 18. The compression sound waves that propagate from second face 18 are reflected off deflector 24 and outward.

Advantages:

In all audio speakers sound vibrations radiate both forwardly and rearwardly of a vibrating diaphragm. When the audio speaker has an enclosed back, rearward vibrations become trapped within the housing. This reduces the sound vibrations that a person sitting in a listening area forward of the audio speaker is exposed to. The trapped rearward vibrations strike the housing and rebound back onto the diaphragm. This diminishes the vibration qualities of the diaphragm and degrades the quality of the sound. As the speed of the vibrations increase, "resonance points" are experiences when the vibrating diaphragm is "in phase" with the rearward vibrations that are rebounding from the housing back onto the diaphragm. These resonance points create an output which is non-linear. With audio speaker 10, deflector 24 deflects rearward vibrations forward into the listening area. This reduces and potentially eliminates, the potential for rebounding rearward vibrations diminishing the vibration qualities of the diaphragm. This also reduces and potentially eliminates resonance points. The result is an audio output that is of greater strength, better quality and substantially linear.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. An audio speaker comprising:

at least one transducer for receiving electrical signals and converting the electrical signals into mechanical motion;

an electrically passive planar sound producing structure having a first face and a second face;

a mechanical connection connecting the at least one transducer to the sound producing structure such that mechanical motion, produced by the at least one transducer, induces the sound producing structure to vibrate and produces sound from the first face and the second face; and a deflector interposed between the at least one transducer and the sound producing structure, the deflector being adjacent to the second face of the sound producing structure, the deflector reflecting the produced sound from the second face of the sound producing structure to a listening area forward of the first face;

wherein the deflector has angled sound reflecting surfaces for reflecting the produced sound around the sound producing structure to the listening area.

2. The audio speaker of claim 1, wherein the sound producing structure is a diaphragm.

3. The audio speaker of claim 2, wherein the diaphragm is supported by a diaphragm supporting structure.

4. The audio speaker of claim 3, wherein the diaphragm supporting structure includes a grid.

5. The audio speaker of claim 2, wherein the diaphragm supporting structure includes two rigid frame members, with the diaphragm being clamped between the two frame members which provide rigid support around a periphery of the diaphragm.

6. The audio speaker of claim 1, wherein the space between the deflector and the sound producing structure is substantially open.

7. The audio speaker of claim 1, wherein the mechanical connection includes a push rod that is moved axially by the at least one transducer.

8. The audio speaker of claim 7, wherein fins are provided on the push rod to dissipate heat generated by the at least one transducer.

9. The audio speaker of claim 7, wherein there is more than one transducer with each transducer being connected to the sound producing structure by a dedicated push rod.

10. An audio speaker comprising:

at least one transducer for receiving electrical signals and converting the electrical signals into mechanical motion;

an electrically passive planar sound producing structure in the form of a diaphragm having a first face and a second face, the diaphragm being supported by a diaphragm supporting structure;

a mechanical connection in the form of at least one axially movable push rod connecting the at least one transducer to the sound producing structure such that mechanical motion of the at least one push rod, produced by the at least one transducer, induces the sound producing structure to vibrate and produces sound from the first face and the second face; and a deflector interposed between the transducer and the sound producing structure, the deflector being adjacent to the second face of the sound producing structure, the deflector having angled sound reflecting surfaces for reflecting the produced sound around the sound producing structure from the second face of the sound producing structure to a listening area forward of the first face.

11. The audio speaker of claim 10, wherein the diaphragm supporting structure includes a grid.

12. The audio speaker of claim 10, wherein the diaphragm supporting structure includes two rigid frame members, with the diaphragm being clamped between the two frame members which provide rigid support around a periphery of the diaphragm.

13. The audio speaker of claim 10, wherein the space between the deflector and the sound producing structure is substantially open.

14. The audio speaker of claim 10, wherein fins are provided on the at least one push rod to dissipate heat generated by the at least one transducer.

15. The audio speaker of claim 10, wherein there is more than one transducer with each transducer being connected to the sound producing structure by a dedicated push rod.

16. The audio speaker of claim 1, wherein the deflector deflects sound away from the sound producing structure.

17. The audio speaker of claim 1, wherein the deflector has a "W" shape.

18. The audio speaker of claim 10, wherein the deflector deflects sound away from the diaphragm.

19. The audio speaker of claim 10, wherein the deflector has a "W" shape.

* * * * *